US006529139B1

(12) United States Patent
Behun et al.

(10) Patent No.: US 6,529,139 B1
(45) **Date of Patent: *Mar. 4, 2003**

(54) TOY HAVING ENCLOSED ANTENNA

(75) Inventors: Catherine H. Behun, White Bear Lake, MN (US); Kaileen Chen, St. Paul, MN (US); Janelle D. Hildebrandt, Medford, OR (US); Robert A. Sainati, Bloomington, MN (US); Gregory D. Allen, Woodbury, MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/972,141

(22) Filed: Nov. 17, 1997

(51) Int. Cl.[7] ..... G08C 19/00; A63H 30/04

(52) U.S. Cl. ..... 340/852.69; 446/456

(58) Field of Search ..... 343/702, 901, 343/895, 792, 802, 768, 777, 789; 340/825.69, 475, 473; 341/20; 455/95, 100; 446/456

(56) References Cited

U.S. PATENT DOCUMENTS

| | | | | |
|---|---|---|---|---|
| 3,689,929 | A | 9/1972 | Moody | 343/802 |
| 3,754,269 | A | 8/1973 | Clavin et al. | 343/742 |
| 3,877,030 | A | 4/1975 | Walker et al. | 343/768 |
| 4,444,199 | A | 4/1984 | Shafer | 128/691 |
| 4,725,827 | A | 2/1988 | Gallegos, Jr. et al. | 340/696 |
| 4,816,836 | A | 3/1989 | Lalezari | |
| 4,859,982 | A | 8/1989 | Seaburg | 340/475 |
| 4,987,424 | A | 1/1991 | Tamura et al. | |
| 5,364,493 | A | 11/1994 | Hunter, Jr. et al. | 156/630 |
| 5,501,944 | A | 3/1996 | Hill et al. | 430/321 |
| 5,541,399 | A | 7/1996 | de Vall | 235/491 |
| 5,625,366 | A | 4/1997 | D'Hoot | 343/718 |
| 5,638,080 | A | 6/1997 | Orthmann et al. | 343/788 |
| 5,654,725 | A | 8/1997 | Kozlovski et al. | 343/792 |
| 5,670,968 | A | 9/1997 | Inanaga et al. | 343/901 |
| 5,757,337 | A | 5/1998 | Hsuch et al. | 343/901 |
| 5,793,331 | A | 8/1998 | Anzai et al. | 343/702 |
| 5,844,244 | A | 12/1998 | Graf et al. | |

FOREIGN PATENT DOCUMENTS

| | | |
|---|---|---|
| FR | 2 748 161 | 10/1997 |
| WO | WO 97/02075 | 1/1997 |
| WO | WO 97 02075 | 1/1997 |
| WO | WO 97/13289 | 4/1997 |
| WO | WO 97 32356 | 9/1997 |

OTHER PUBLICATIONS

"Ricochet" Product Instruction, Kenner/Tonka Corporation, Copyright 1995.
"Tyco R/C 6.0v Jet Turbo", "6.0v Jet Turbo Rebound 4×4", "Exclusive Rebound 4x4 Stunts", Product Instructions, Tyco Industries, Inc., Copyright 1995.
"Tyco R/C 6.0 Jet Turbo", "6.0v Jet Turbo Rebound 4×4", Owner's Manual, Tyco Industries, Inc., Copyright 1994.
"Turbo Touch Racer" Product Instructions, JAKKS Pacific, Inc., Copyright 1996.
Hasbro Inc. Product Brochure, 88127300, Hasbro Inc., Front Page, Back Page, and Page Displaying Certain "XRC™ Radio Control Series" Products, Copyright 1996.

*Primary Examiner*—Michael Tokar
*Assistant Examiner*—Jean Bruner JeanGlaude
(74) *Attorney, Agent, or Firm*—Gregory D. Allen

(57) ABSTRACT

Enclosed antenna for use in toy remote control assemblies. In one aspect the antenna is a flexible antenna which can be flexed to fit within housings of remote control devices and toys (e.g., toy vehicles). The flexible antenna may include an electrically conductive layer coupled to a flexible substrate, wherein the electrically conductive layer is in the shape of an antenna pattern.

26 Claims, 7 Drawing Sheets

TOY HAVING ENCLOSED ANTENNA

FIELD OF THE INVENTION

The present invention relates to an enclosed antenna for remote controlled toys.

BACKGROUND OF THE INVENTION

Remote controlled toys (e.g., remote control cars and boats), typically have a generally rigid wire antenna extending from both the transmitting, remote control device and the receiving, remote control toy vehicle, although some remote controlled vehicles (e.g., a remote controlled toy car commercially available under the trade designation "RICOCHET" from Hasbro, Inc. of Pawtucket, R.I.) have an antenna (e.g., a spiral wire) concealed in the vehicle. Remote control devices used for remote controlled toy vehicles transmit a radio frequency signal (e.g., typically 27 MHz or 49 MHz in the United States) via the rigid wire antenna (which may be a retractable antenna) to the antenna in or on remote control toy vehicle for operation of the vehicle. The antennae are often unavoidably damaged by children, such as being bent or broken, during normal use of the toy. For safety purposes, some wire antennas are often partially coated with plastic, and may even be non-rigid (e.g., Jakks Pacific, Inc., of Malibu, Calif. markets a remote controlled toy car under the trade designation "TURBO TOUCH RACER", wherein the antenna in the remote control device is an external, flexible, plastic coated wire about 32 cm long). The remote control device transmitters typically have a range of up to 18.3–22.9 m (60–75 feet).

The required length of the antenna is a function of the operating frequency. Ideally, for a monopole antenna (e.g., the rigid wire antenna on the remote control device), the length of the wire should be about a ¼ wavelength. This translates into a length of about 2.77 m (109 inches) at 27 MHz or about 1.52 m (60 inches) at 49 MHz. Since these lengths are impractical for remote controlled toys, much shorter antennas are employed. The use of much shorter antennas requires additional circuit tuning elements, such as inductors and capacitors, to compensate for the shorter antenna length. The compensated antenna is not as good as a correct length antenna, so usually there is some minimum length which is needed for satisfactory performance.

Some consumer radio frequency based products (e.g., garage door openers or telephones) operate at significantly higher frequencies than remote controlled toys (e.g., 400 MHz garage door openers or 900 MHz telephones). Garage door openers typically have no external antennae, instead having a conducting trace along the edge of a printed circuit board containing the transmitter electronics. The trace serves as the transmitting antenna and fits within the remote transmitter housing. As stated previously, required antenna length is related to the device transmitting frequency (i.e., the higher the frequency, the shorter the required antenna length). Since garage door openers generally operate at 400 MHz , about ten times the frequency of remote controlled toys, only a relatively short conducting trace is necessary (i.e., a few inches).

SUMMARY OF THE INVENTION

The present invention provides a flexible, enclosed antenna for use in remote control toys including remote control devices and remote control vehicles (including cars and boats). If the enclosure is sufficiently opaque such that the antenna is not viewable therethrough, the antenna is "concealed".

In one exemplary embodiment, the present invention provides a remote control device for use with a remote control toy, the remote control device including a housing and a flexible antenna mechanism enclosed or concealed within the housing. The flexible antenna mechanism comprises a flexible sheet material (substrate) that includes an electrically conductive layer on a major surface thereof. A controller is electrically coupled to a user input mechanism for transmitting an output signal to the remote control toy via the flexible antenna mechanism, wherein the output signal is representative of a control input received from the user input mechanism.

The electrically conductive layer may be on a major surface of the flexible substrate. The electrically conductive layer may include a highly electrically conductive material (e.g., metal, such as copper), which may be in the form of an electrically conductive trace. The flexible sheet material (substrate) preferably includes a dielectric material (e.g., a polymeric material, such as polyester).

The flexible sheet material (substrate) and the electrically conductive layer may be curved to fit or otherwise be accommodated within the housing. Example antenna patterns include an open loop, spiral shape, or slot antenna pattern.

The controller may include a radio frequency transmitter for transmitting the output signal via the flexible antenna mechanism. In one application, for example, the output signal is a radio frequency signal transmitted at 49 MHz . In another application, for example, the output signal is a radio frequency signal transmitted at 27 MHz .

In another embodiment, the present invention provides a remote controlled toy assembly. The assembly includes a remote control device having a housing and a flexible transmitting antenna mechanism enclosed or concealed within the housing. The flexible transmitting antenna mechanism includes a flexible sheet material (substrate) that includes an electrically conductive layer on a major surface thereof. A controller is electrically coupled to an input mechanism for transmitting output signals via the flexible transmitting antenna mechanism. The output signals are representative of a control input received from the user input mechanism. A remote control toy is responsive to the output signals for operation of the remote control toy.

The electrically conductive layer includes a highly electrically conductive metal. The flexible sheet material (substrate) includes a dielectric material. Additionally, the remote controlled toy includes a housing, a flexible receiving antenna mechanism enclosed or concealed within the housing, a control mechanism and a power source coupled to the control mechanism. The flexible receiving antenna is coupled to the control mechanism for receiving the output signals. The flexible receiving antenna mechanism comprises a flexible substrate and an electrically conductive layer.

In another aspect, the present invention provides a remote control device for use with a remote control toy. The remote control device includes a housing and an antenna mechanism enclosed within the housing. The antenna mechanism includes an electrically conductive layer positioned on (e.g., deposited on or otherwise applied, or at least partially embedded within) an interior surface of the housing. A user input mechanism is provided. A controller is electrically coupled to the user input mechanism for transmitting an output signal to the remote control toy via the antenna mechanism, wherein the output signal is representative of a control input received from the user input mechanism.

In this application, the term "highly electrically" refers to a material having a sufficiently low impedance such that the electrically conductive properties of the material do not result in substantial attenuation of signals transmitted therethrough. The term "dielectric material" refers to a substantially electrically non-conductive material. The term "flexible" antenna refers to an antenna which is capable of being easily hand-folded, flexed, twisted or bent.

Preferably, vehicles operated with remote control devices according to the present invention can operate together at distances of at least about 18.3–22.9 meters (60–75 feet), or even 30.5 meters (100 feet) or more, wherein the longer distances are typically more easily achieved in outdoor areas. Indoor areas typically have more sources of interference (e.g., structural elements, plumbing, wires, etc.).

BRIEF DESCRIPTION OF THE DRAWINGS

The accompanying drawing is included to provide a further understanding of the present invention and is incorporated in and constitutes a part of this specification. The drawing illustrates exemplary embodiments of the present invention and together with the description serves to further explain the principles of the invention. Other aspects of the present invention and many of the attendant advantages of the present invention will be readily appreciated as the same becomes better understood by reference to the following Detailed Description when considered in connection with the accompanying drawing, and wherein.

DETAILED DESCRIPTION

Figure 1:
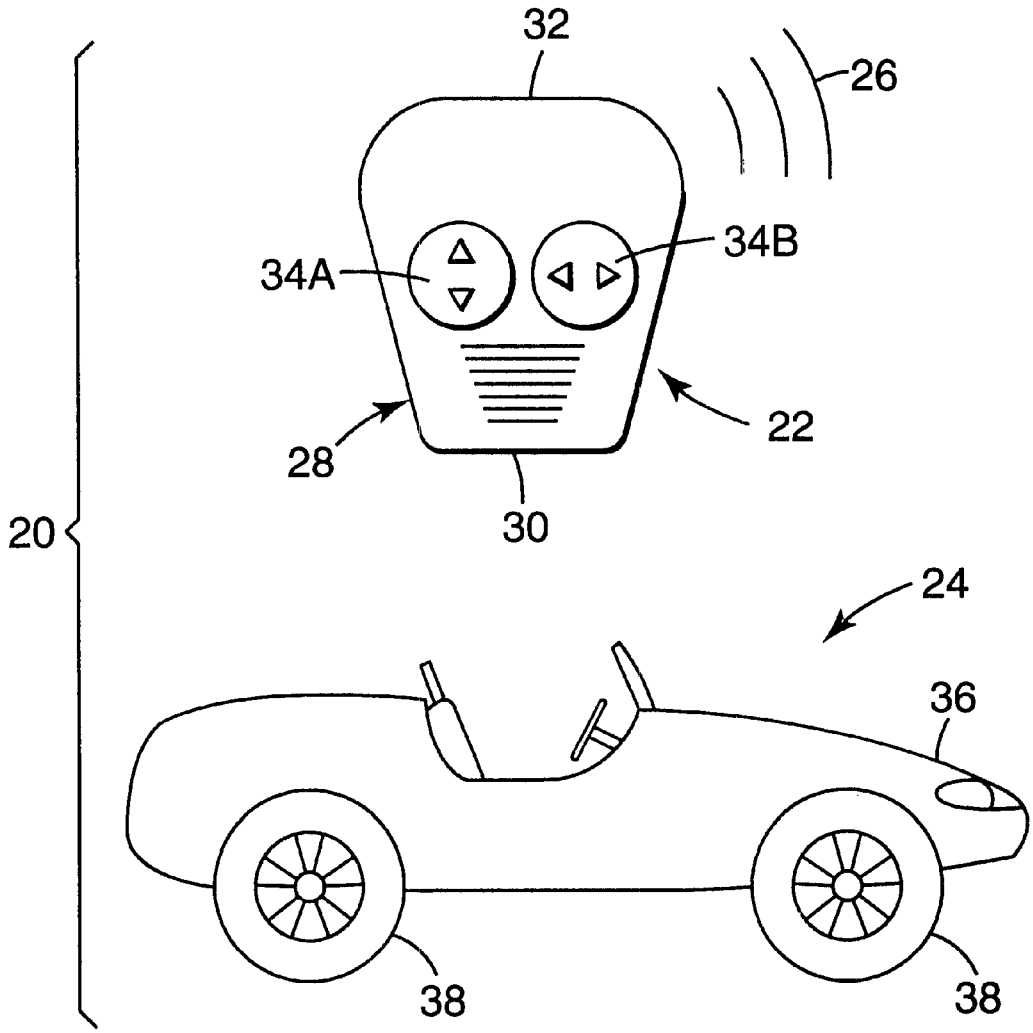
FIG. 1 is an elevational view of a remote control toy assembly in accordance with the present invention.

Referring to FIG. 1, exemplary remote control toy system 20, including remote control device 22 and remote control toy vehicle 24, is shown. Remote control device 22 includes remote control device housing 28 having first (proximal to the user) portion 30, second (distal to the user) portion 32, and input devices 34A and 34B (shown as buttons) extending through the remote control device housing 28. Housing 28 can be constructed, for example, of a generally rigid polymeric material. Similarly, toy vehicle 24 includes vehicle housing or body 36 and drive wheels 38.

In operation, remote control device 22 receives a user input from input device 34A and/or 34B (shown as buttons extending through remote control housing 28) and transmits a control signal 26, (e.g., a radio frequency signal) to remote control toy vehicle 24. Remote control toy vehicle 24 is responsive to control signal 26 for operation of remote control toy vehicle 24.

Figure 2:
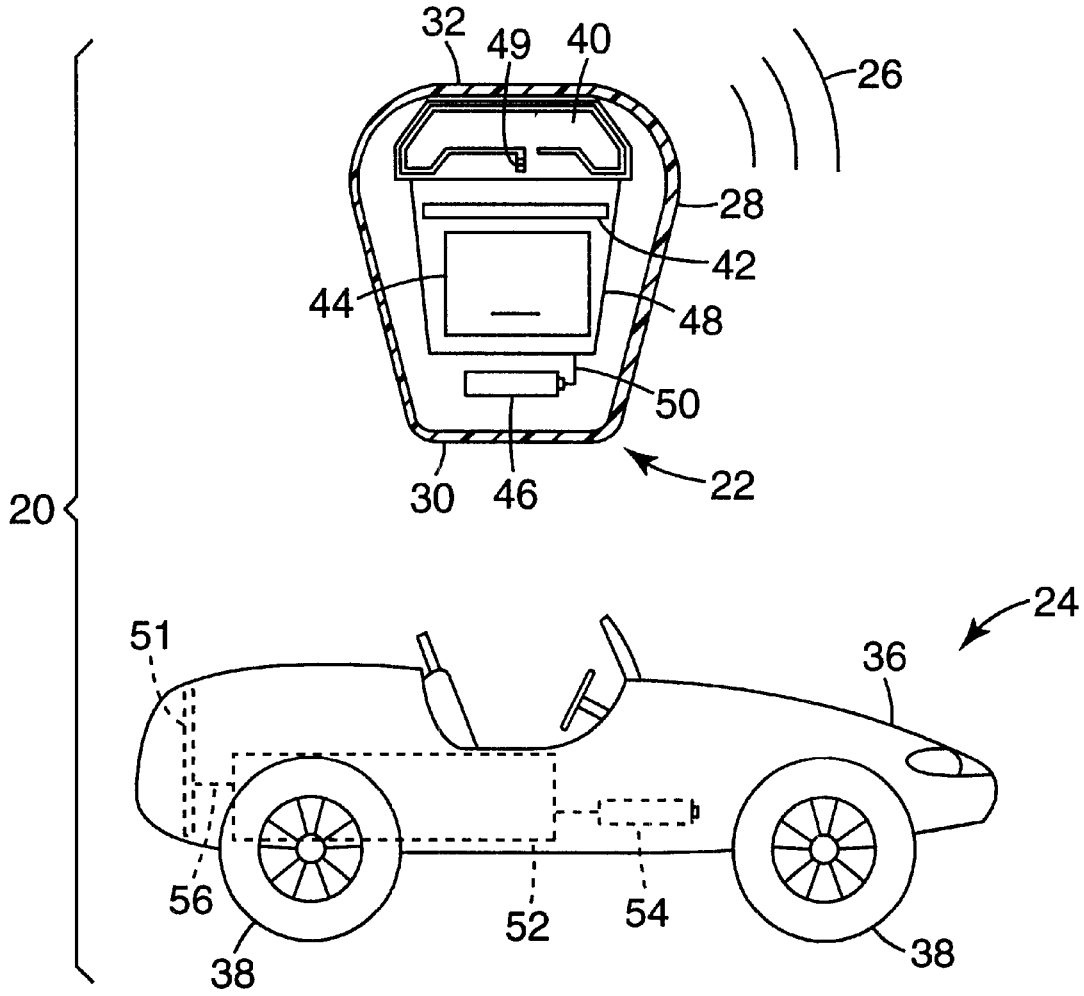
FIG. 2 is a diagrammatic view of the remote control toy assembly of FIG. 1, having a portion of the remote control housing removed.

Referring to FIG. 2, concealed within remote control device 22 are flexible antenna 40, ground bus 42, controller 44, and power source 46. Ground bus 42 and controller 44 are located on rigid circuit board 48, which can be, for example, formed from conventional printed circuit board construction techniques as is known in the art. Ground bus 42 is preferably positioned between flexible receiving antenna 40 and controller 44, and preferably is formed of a highly electrically conductive material (e.g., metal, such as copper). Flexible antenna 40 is mechanically coupled to antenna mount 49. In one embodiment, flexible antenna 40 is bolted to antenna mount 49. Antenna mount 49 is coupled to a pad above ground bus 42 for coupling the flexible antenna to controller 44.

Power source 46 is coupled to controller 44, indicated at 50. In one preferred embodiment, power source 46 is a DC battery or batteries (e.g., one 9 volt battery or two 3 volt batteries). In another embodiment, power source 48 may be an AC power source and include an AC/DC converter and a mechanism for coupling the transmitter to an AC power source (e.g., 120 volt or 220 volt AC source), such as a conventional extension cord.

A flexible antenna in accordance with the present invention, such as flexible antenna 40, is concealed or enclosed by a remote control device housing. As such, the flexible antenna does not extend outside of the housing where it is more susceptible to abuse or damage. The flexible antenna "flexes", allowing it to fit within a remote control device housing, and conform to the shape of the housing if necessary. Further, the antenna pattern may also be varied, such as curved, circular, or spiral shapes, allowing a longer length antenna to be more easily placed within a limited area within the remote control device. In particular, the shape of the antenna pattern may be varied to fit the shape of the remote controlled device.

Remote control device antenna 40 is preferably located near remote control device second portion 32, positioned away from the user. Locating the antenna at one end of the housing, and positioning the ground bus between the antenna and the controller, reduces possible interference caused by interaction between the controller electronics and the antenna. Further, locating the antenna away from the expected position of the user reduces interference which may be caused by the user. In particular, for maximum operating efficiency of remote control device 22, a user's hands are positioned at first end 30 for user control of input devices 34. The second end 32, including flexible antenna 40, is pointed away from the user at remote controlled toy vehicle 24. Inadvertent positioning of a user's hands over the second end 32 (and/or flexible antenna 40), results in an attenuated signal transmitted by flexible antenna 40 (due to absorption by the hand and/or detuning of the antenna impedance caused by the proximity of the hand). Further, locating the flexible antenna away from power source 46 reduces interference which may be caused by the power source.

Toy vehicle 24 contains an antenna for receiving control signals transmitted from flexible antenna 40. Preferably, toy vehicle 24 contains a flexible antenna (indicated at 51), which can be similar to flexible antenna 40, and is described in detail further in this specification. Toy vehicle 24 also includes control mechanism 52 and power source 54. Control mechanism 52 may include operational devices such as a receiver, controller, and motor, for operation of toy vehicle 24 (in particular, drive wheels 38). Control mechanism 52 is mechanically coupled to flexible antenna 51 at antenna mount 56. Power source 54 can be similar to power source 46 as previously described herein. For example, power source 54 can be a 6 or 9 volt DC NiCad battery, which may be rechargeable.

Figure 3:
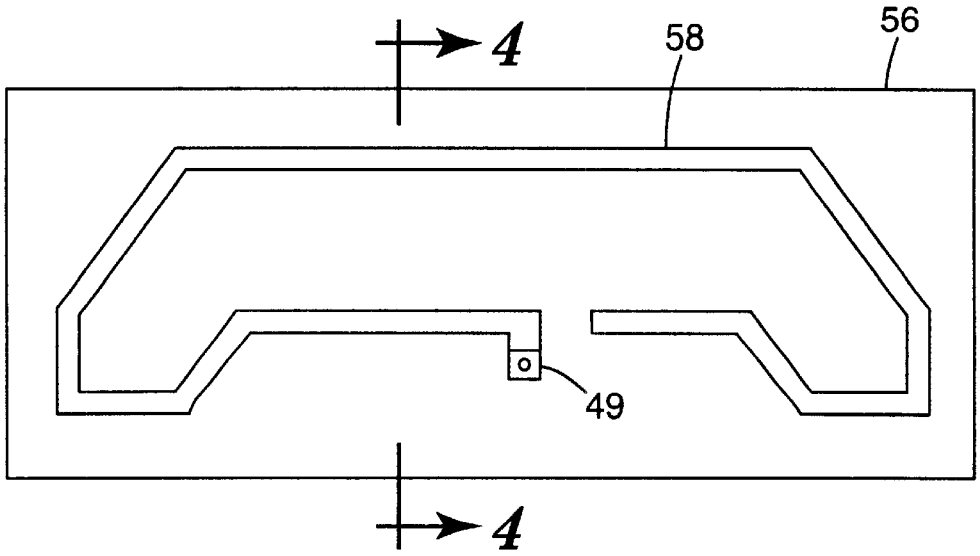
FIG. 3 is a top view of a flexible antenna according to the present invention.

Referring to FIG. 3, one exemplary embodiment of a flexible antenna suitable for use as flexible antenna 40 or flexible antenna 51 is shown. The flexible antenna is preferably formed of electrically conductive layer 58 adhered to or deposited in a desired antenna pattern on flexible substrate 56. In a preferred embodiment, conductive layer 58 includes attachment portion 49, adapted to be electrically connected to a conventional antenna connector. In one embodiment, attachment portion 49 receives a screw driven through the conductive layer. In another embodiment, a wire is attached (e.g. by soldering) to conductive layer 58 at attachment portion 49.

Figure 4:
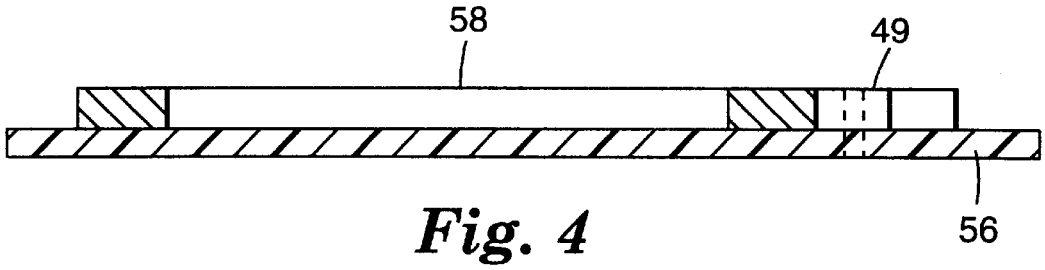
FIG. 4 is a cross-sectional view of the flexible antenna of FIG. 3 taken along line 4—4.

In FIG. 4, a partial cross-sectional view of a flexible antenna is shown, taken along lines 4—4 of FIG. 3. In one embodiment, conductive layer 58 is preferably formed of a highly electrically conductive material (e.g., metal, such as copper). The thickness of the electrically conductive material is typically in the range from about 0.1 micrometer to about 5 micrometers; preferably, about 0.25 micrometer to about 2 micrometers; more preferably, about 0.25 micrometer to about 0.75 micrometer. The range of 0.25 micrometer to 0.75 micrometer is most preferred because it tends to be the easiest to apply and ablate, and to maintain its flexibility.

Flexible sheet material (substrate) 56 is preferably formed of a dielectric material available, for example, under the trade designation "ICI-MELINEX" from Imperial Chemical Industries, Hopewell, Va.; PEN (polyethylenenathalate), available, for example, under the trade designation "KALADEX" from Dumfries of Scotland;, polyimide, available, for example, under the trade designation "KAPTON" from DuPont, Wilmington, Del. Other suitable sheet material (substrate) may also include polyetherimide and polyamide. The thickness of the flexible sheet material (substrate) is typically in the range from about 12.7 micrometers (0.5 mil) to about 177.8 micrometers (7 mils), preferably, about 25.4 micrometers (1 mil) to about 76.2 micrometers (3 mils), more preferably, about 25.4 micrometers (1 mil) to about 50.8 micrometers (2 mil). The most flexible and easiest to handle during the making of the antenna is the 25.4–50.8 micrometer (1–2 mil) sheet material (substrate).

One embodiment of a flexible antenna in accordance with the present invention utilizes a polyester substrate having a thickness of about 0.05 mm (2 mils). The conducting layer in the form of a desired antenna pattern is deposited at a thickness of 0.0127 mm (0.5 mil). In one method of construction, flexible antenna 40 can be formed by providing a copper coated polyester substrate and laser ablating unwanted copper from the surface, leaving electrically conductive portion 58 in a desired antenna pattern, for example, such as the general "C" shape illustrated in FIG. 3. Embodiments of flexible antennas in accordance with the present invention can be mass produced using economical manufacturing processes. The partially closed (loop) shape allows an antenna of substantial total length to be placed on a flexible sheet material (substrate) having a maximum dimension less than the total antenna length.

Figure 5:
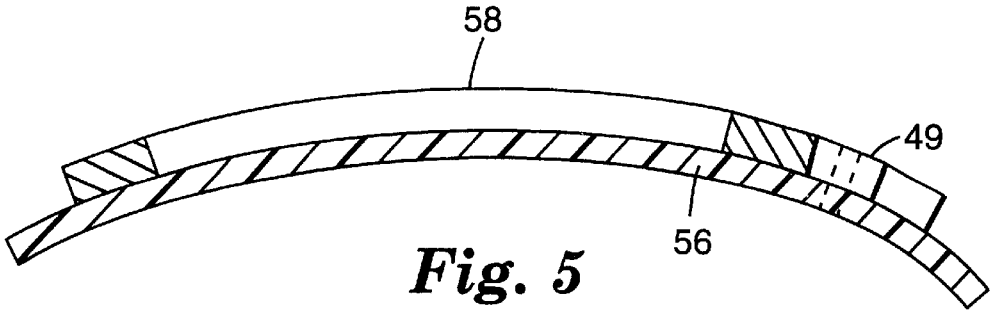
FIG. 5 is a cross-sectional view of a flexible antenna in accordance with the present invention in a curved position.

Referring to FIG. 5, an exemplary application of flexible sheet material (substrate) layer 56 in a flexed or curved configuration is shown. The flexed configuration allows placement of the antenna within, for example, a small and irregularly shaped space. Additionally, the antenna may be fit within previously designed toys as a replacement for an external antenna, as the flexible sheet material (substrate) can be flexed to fit within unused space between the inner electronics and the outer housing.

Figure 6:
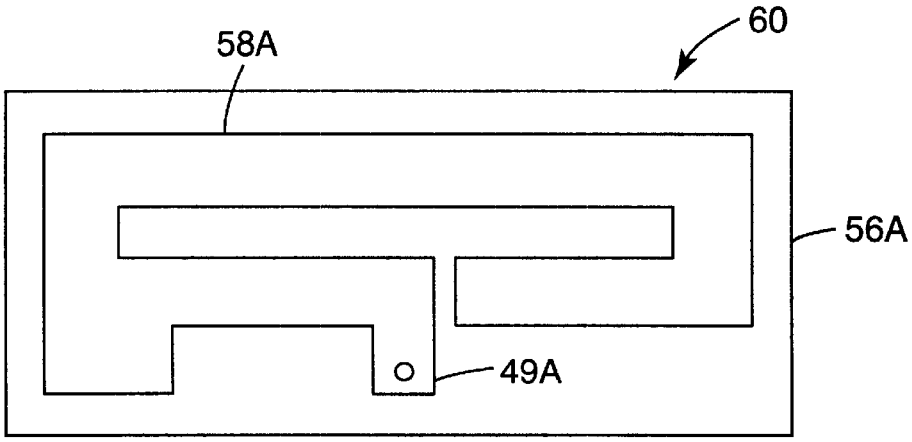
FIG. 6 is a top view of an exemplary embodiment of another flexible antenna min accordance with the present invention.
Figure 7:
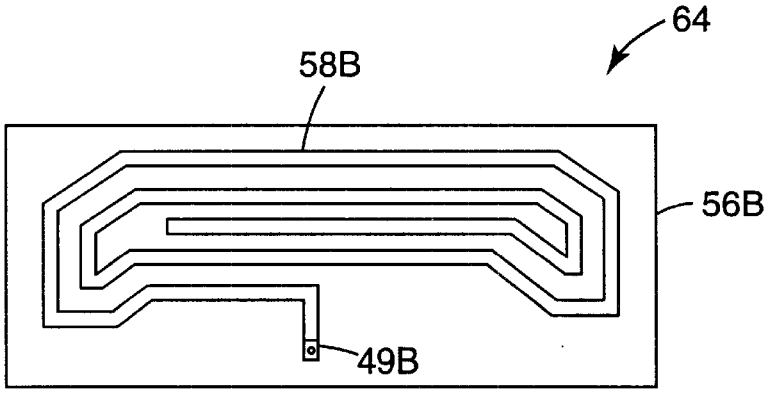
FIG. 7 is a top view of another exemplary embodiment of a flexible antenna in accordance with the present invention having a spiral shaped antenna pattern.
Figure 8:
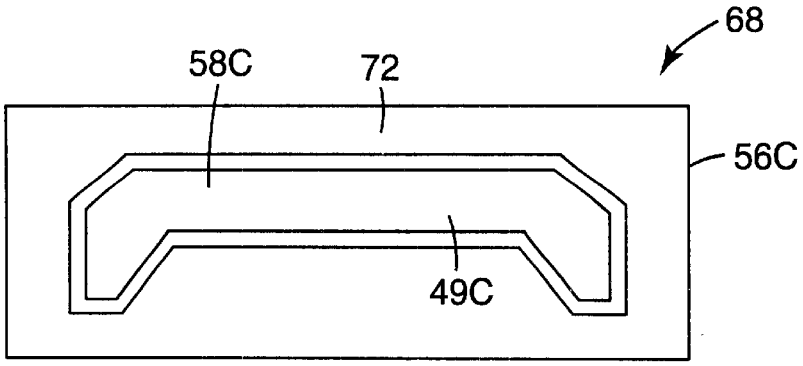
FIG. 8 is a top view of another exemplary embodiment of a flexible antenna in accordance with the present invention having a slot antenna pattern, wherein an aperture in a ground plane serves as the antenna.

Referring to FIGS. 6, 7, and 8, alternative exemplary embodiments of a flexible antenna in accordance with the present invention are shown. Variations in antenna geometry or antenna pattern shape, such as conductor width, are easily attainable within the scope of the present invention by varying the pattern of the conductive layer upon the flexible sheet material (substrate). In FIG. 6, antenna 60, which is similar to the antenna in FIG. 3, has flexible sheet material (substrate) 56A, conductive layer 58A (which is wider than conductive layer 58 in FIG. 3), and attachment portion 49A.

In FIG. 7, flexible spiral antenna pattern 64 is shown, having a spiral shaped conductor 58B on flexible sheet material (substrate) 56B, and attachment portion 49B. The spiral shape is one method of maximizing antenna length within a confined area.

In FIG. 8, another suitable antenna pattern is illustrated in flexible slot antenna 68, which has flexible sheet material (substrate) 56C, conductive layer 58C encircled by ground plane 72, and attachment portion 49C. The conductive layer 58C is separated from ground plane 72 by a continuous slot. Antenna conductive layer 58C can be attached to a controller using methods previously described herein, such as by using a screw or soldered wire making contact with the conductor. In a preferred embodiment, both antenna conductor 58C and ground plane 72 are formed of a copper layer. The ground plane 72 is connected to an appropriate ground bus on the controller printed circuit board.

Figure 9:
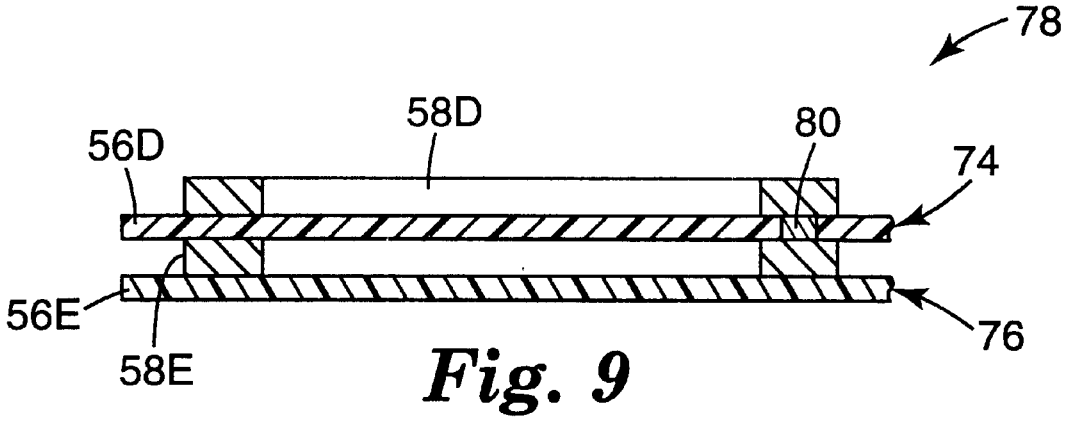
FIG. 9 is a cross-sectional view of another exemplary embodiment of a flexible antenna in accordance with the present invention.
Figure 10:
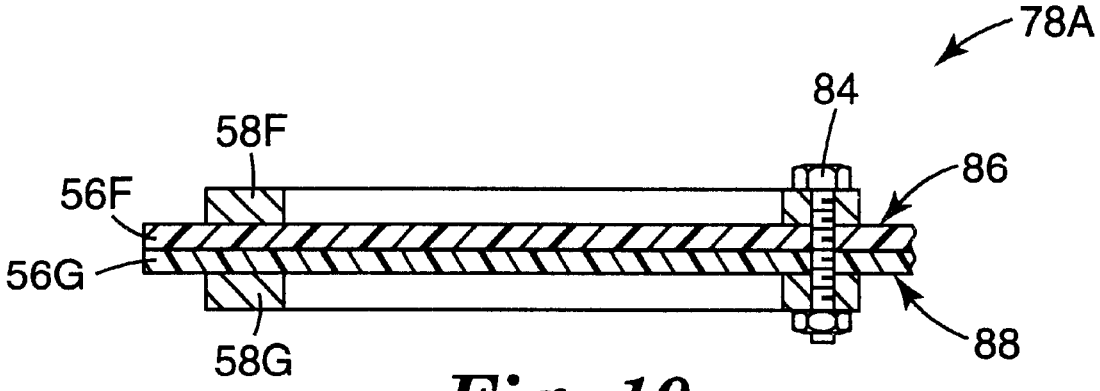
FIG. 10 is a cross-sectional view of another exemplary embodiment of a flexible antenna in accordance with the present invention.

Referring to FIG. 9, another exemplary embodiment of a flexible antenna in accordance with the present invention is shown, wherein the antenna occupies a three-dimensional space. For example, multiple flexible antenna layers may be stacked or sandwiched together, allowing placement of even longer total length antennae within a smaller space. Stacked flexible antenna 78 includes first antenna layer 74 stacked on second antenna layer 76. First layer 74 and second antenna layer 76 can be similar, for example, to flexible antenna 40 previously described herein. First layer 74 has electrically conductive layer 58D on flexible sheet material (substrate) 56D; second layer 76 has electrically conductive layer 58E on flexible layer 56E. First layer 74 is electrically coupled to second layer 76 with antenna interconnect 80. Stacked antenna 78 allows use of multiple antenna layers to create a longer total length antenna within a small (three-dimensional) space. In stacked antenna 78, the multiple flexible antenna layers are stacked front to back, allowing stacking of several antenna layers. Additional antenna layers may be stacked together as desired to achieve longer antenna lengths.

In FIG. 19, another exemplary embodiment of a flexible antenna in accordance with the present invention is shown, where the antenna occupies a three-dimensional space using a back-to-back configuration. Stacked flexible antenna 78A includes first layer 86 and second layer 88. First layer 86 has electrically conductive layer 58F on flexible sheet material (substrate) 56F; second layer 88 has electrically conductive layer 58G on flexible layer 56G. First layer 86 is illustrated as electrically coupled to second antenna layer 88 with layer interconnect device 84. Layer interconnect device 84 can be an electrically conductive bolt or other fastener capable of both conducting electricity and securing one antenna layer to another. It is recognized that other mechanisms may be provided for securing one antenna layer to another (e.g., an adhesive material).

As previously indicated herein, a flexible antenna in accordance with the present invention can be made using a laser ablation process. One suitable method of construction includes depositing a primer layer on the sheet material (substrate) surface in the form of a continuous layer, followed by deposition of a metal (conductive) layer (also, in the form of a continuous layer). One preferred technique for both primer and metal deposition is vacuum metalization using an art-recognized process. Prior to primer deposition, the sheet material (substrate) surface may be treated to enhanced adhesion between the primer and sheet material (substrate) surface. Examples of suitable priming processes include plasma treatment, corona discharge, flame printing, and flashlamp priming (as described, for example, in U.S. Pat. No. 4,822,451 (Ouderkirk et al.), herein incorporated by reference), with flashlamp priming being a preferred embodiment.

Following metal deposition, a pattern of interest (e.g., an antenna pattern) is printed on the metal surface using conventional ink printing equipment such as a rotary letter press, flexography, or screen printing. Once the ink has dried or cured, both the metal and primer outside of the ink printing are removed by exposing the article to a wet etchant such as a ferric chloride solution or sulfuric acid, an ablation source such as a excimer laser, flashlamp, or accelerated plasma according to the process described in U.S. Pat. No. 5,178,726 (Yu et al.), herein incorporated by reference, or a combination thereof. The resulting flexible antenna is then outfitted with a suitable connector for coupling to the toy. Other suitable ablation processes for making a flexible antenna in accordance with the present invention are described, for example, in U.S. Pat. No. 5,501,944 (Hill et al.), U.S. Pat. No. 5,364,493 (Hunter, Jr. et al.), and PCT International Application No. PCT/US96/13823, having Publication No. WO/97/12389, published Apr. 10, 1997, the disclosures of which are incorporated herein by reference.

Figure 11:
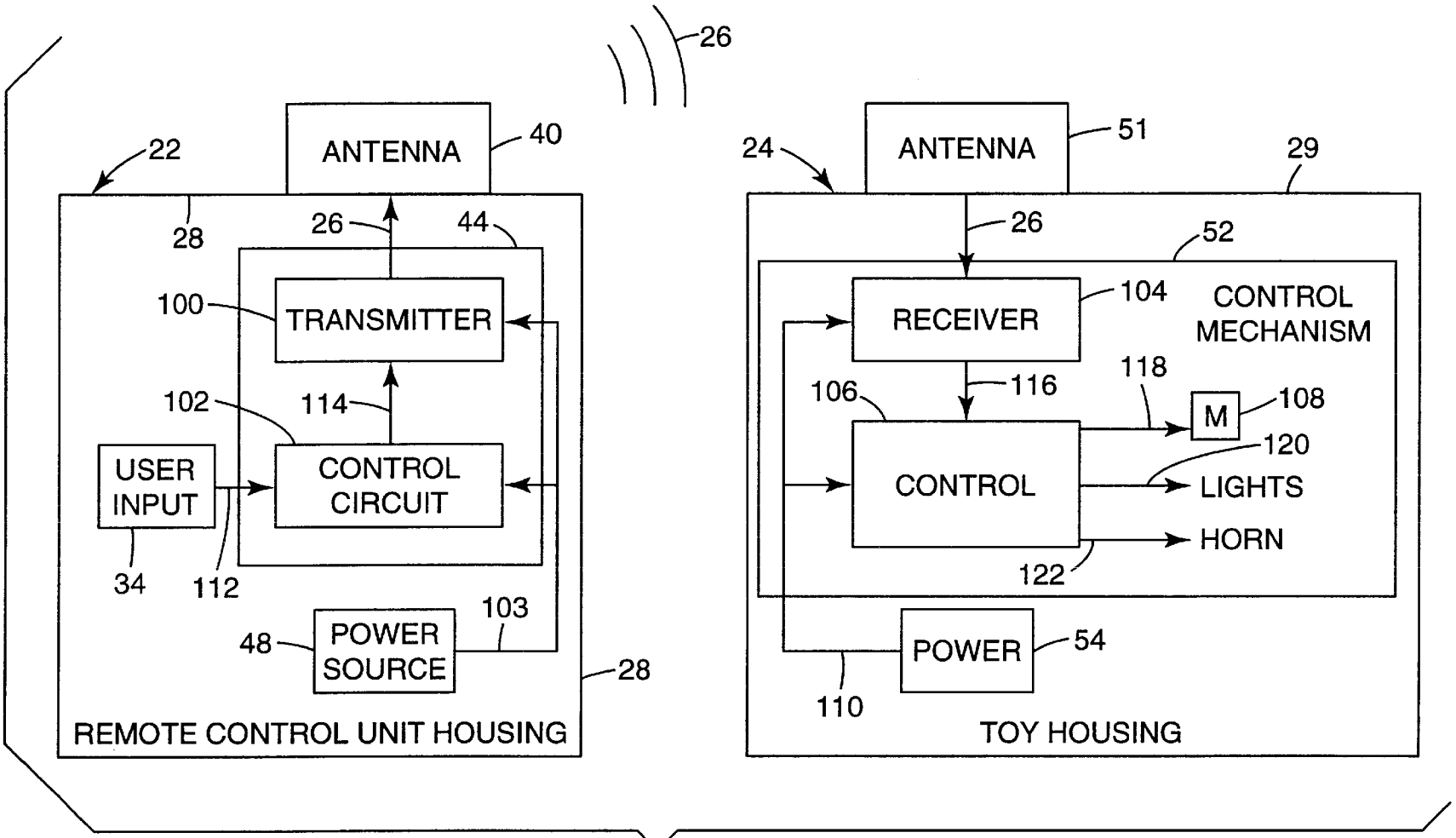
FIG. 11 is a block diagram illustrating operation of a remote control toy assembly in accordance with the present invention.

FIG. 11 includes an example system diagram illustrating operation of remote control toy system having a concealed antenna in accordance with the present invention. Remote control device 22 includes user input 34, concealed antenna 40, controller 44, and power source 48 as previously described herein. Controller 44 further includes transmitter 100 and control circuit 102. Similarly, remote control toy 24 includes concealed flexible antenna 51, toy housing 29 control mechanism 52, and power source 54. Control mechanism 52 further includes receiver 104, control 106, and motor 108. In operation, power source 48 provides power to controller 44, and in particular, transmitter 100 and control circuit 102, indicated at 103. Upon operation of user input device 34 (such as button 34A and/or 34B shown in FIG. 1), a corresponding user input signal 112 is input to control circuit 102. Control circuit 102 is responsive to user input signal 112 and provides a corresponding output signal 114 to transmitter 100 which is representative of the desired control function.

Transmitter 100 is responsive to input signal 114 for transmitting output signal 26 via concealed flexible antenna 40 to toy 24. In one exemplary embodiment, output signal 26 is a relatively low radio frequency signal. In one preferred embodiment, output signal 26 is transmitted at 27 MHz or 49 MHz . Transmitter 100 may also include (i.e., in addition to or "alternative ways") ways of transmitting an output signal, such as amplifiers, filters, tuners, oscillators and modulators. Control circuit 102 may comprise, for example, a microcomputer, microprocessor, a series of logic gates or other circuit components capable of performing a sequence of logical operations.

In one preferred embodiment, output signal 26 is transmitted via concealed flexible antenna 40 at a frequency of 27 MHz or 49 MHz . Signal 26 is received by toy 24 within a typical maximum range of up to 18.3–22.86 m (60–75 feet).

Signal 26 is received by toy 24 via enclosed or concealed flexible antenna 51, and transmitted to receiver 104. In operation, power source 54 provides power to controller 52, and in particular, receiver 104 and control circuit 106, indicated at 110. Receiver 104 is responsive to signal 26, and provides a corresponding output signal 116 to control system 106. In response to signal 116, control system 106 provides output signals for operation of toy 24. For example, motor 108 is mechanically coupled to drive wheels 38 (indicated in FIG. 1 and FIG. 2). Control system 106 can provide an output signal 118 to motor 108 for operation of drive wheels 38, including turning wheels 38 for steering of toy 24. Further, control system 106 can be employed to provide other operational control output signals, such as output signal 120 for operation of toy lights or output signal 122 for operation of a toy horn.

Preferably, an antenna in accordance with the present invention is sufficiently flexible to be capable of being wrapped around a curvature, or if the antenna has sufficient length, wrapped around a rod, having a diameter of 25.4 mm (1 inch), more preferably, a diameter of 12.7 mm (0.5 inch), and even more preferably, a diameter of 2.54 mm (0.1 inch) (or less) without breaking the conductor traces and/or severing or cracking the sheet material (substrate).

For example, an antenna as shown in FIG. 6 having a 0.5 micrometer thick, and average 10.16 millimeter (0.4 inch) wide copper conductive layer on a 50.8 micrometer (2 mil) thick polyester sheet material (substrate) was wrapped around a rod of diameter 12.7 mm (0.5 inch) with no visible signs of the conductor traces breaking and/or the substrate severing or cracking. Further, the antenna was unwrapped from the rod and was then used as an antenna within a remote control device (with the top of the device off) for a toy car (obtained under the trade designation "TYCO REBOUND 4×4" from Mattel, Inc., El Segundo, Calif.). In other words, the original antenna for the remote control device was removed and replaced with the flexible antenna (which had been wrapped around the rod). The remote control device and toy car were observed to function together at a distance of at least about 16.15 meters (53 feet), which is the same distance observed using the same flexible antenna before it had been wrapped around the rod (and then unwrapped).

Figure 12:
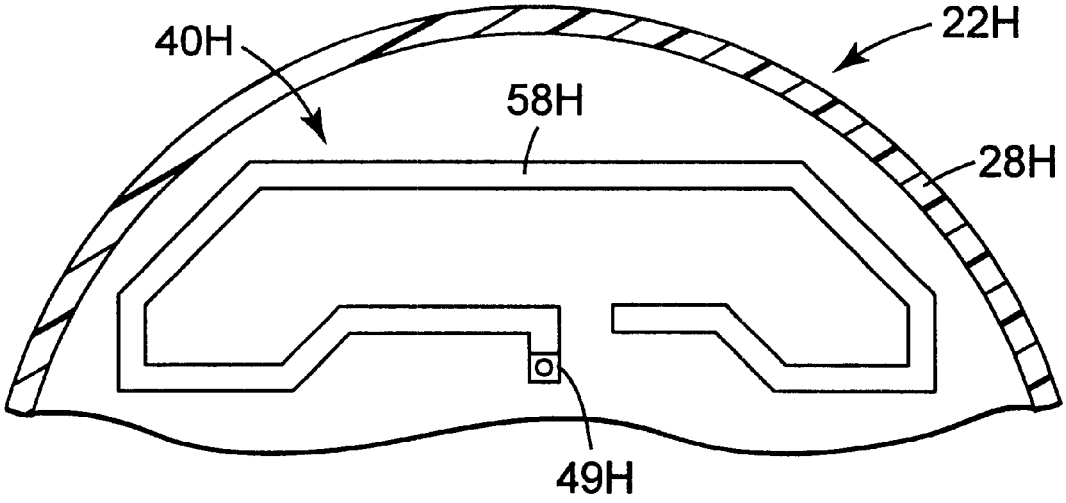
FIG. 12 is a partial plan view illustrating another exemplary embodiment of a remote control device in accordance with the present invention having a portion of the housing removed.

In FIG. 12, another exemplary embodiment of a remote control device in accordance with the present invention 22H (having a portion of the housing removed) is shown, wherein antenna mechanism 40H, including electrically conductive layer 58H, is coupled to housing 28H along its length. Electrically conductive layer 58H may be positioned on or embedded within housing 28H (e.g., deposited or otherwise applied, including using laser etching techniques). Electrically conductive layer 58H can be similar to the electrically conductive layers as previously described herein. In one aspect, metal is deposited over the entire interior surface of housing 28H in a desired antenna pattern. In one application, a process such as laser direct write imaging can be used to create the desired conductor pattern for the electrically conductive layer 58H and attachment 494. Other processes (e.g., ink jet printing) can also be used to deposit the metalization in the desired conductor pattern on the interior surface of the housing 28H. Optionally, a cover layer (e.g., a polymeric material; optionally, for example, transparent or opaque) may be positioned over electrically conductive layer 58H, and coupled to the interior surface of housing 28H, to further protect and/or support electrically conductive layer 58H.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. A remote control toy assembly comprising:

a remote control device comprising a housing, a flexible transmitting antenna mechanism enclosed within said housing, a user input mechanism, and a controller electrically coupled to said user input mechanism for transmitting output signals via said flexible transmitting antenna mechanism, said flexible transmitting antenna mechanism comprising a flexible sheet material that includes an electrically conductive layer on a major surface thereof, wherein said output signals are representative of a control input received from said user input mechanism; and a remote control toy responsive to said output signals for operation of said remote control toy.

2. The assembly of claim 1, wherein said flexible sheet material includes a dielectric material.

3. The assembly of claim 1, wherein said electrically conductive layer includes copper metal.

4. The assembly of claim 1, wherein said flexible sheet material and said electrically conductive layer are curved within said housing.

5. The assembly of claim 1, wherein said electrically conductive layer is in an open loop pattern.

6. The assembly of claim 1, wherein said electrically conductive layer is in a generally spiral shaped pattern.

7. The assembly of claim 1, wherein said electrically conductive layer is in a slot antenna pattern.

8. The assembly of claim 1, wherein said electrically conductive layer has a pattern shape corresponding to the shape of said housing.

9. The assembly of claim 1, wherein said antenna mechanism is concealed.

10. The assembly of claim 1, wherein said antenna is concealed.

11. The assembly of claim 1, wherein said flexible antenna is flexed within said housing.

12. The assembly of claim 1, wherein the flexible antenna mechanism has sufficient flexibility that upon being wrapped and unwrapped around a rod having a diameter of 12.7 said electrically conductive layer does not break, and said flexible substrate does not sever or crack.

13. The assembly of claim 1, wherein the flexible antenna mechanism has sufficient flexibility that upon being wrapped and unwrapped around a rod having a diameter of 2.54 millimeters said electrically conductive layer does not break and said flexible substrate does not sever or crack.

14. The assembly of claim 1, wherein said electrically conductive layer includes a dielectric material.

15. The assembly of claim 1, wherein said flexible sheet material is made of a polymeric material.

16. The assembly of claim 15, wherein said polymeric material is made of polyester.

17. The assembly of claim 1, wherein said controller includes a radio frequency transmitter for transmitting said output signal via said flexible antenna mechanism.

18. The assembly of claim 17, wherein said output signal is a radio frequency signal transmitted at 49 MHz.

19. The assembly of claim 17, wherein said output signal is a radio frequency signal transmitted at 27 MHz .

20. The assembly of claim 1, wherein said remote control toy includes a housing, a flexible receiving antenna mechanism enclosed within said housing, a control mechanism, and a power source coupled to said control mechanism.

21. The assembly of claim 20, wherein said flexible receiving antenna mechanism is coupled to said control mechanism for receiving said output signals.

22. The assembly of claim 20, wherein said flexible receiving antenna mechanism comprises a flexible sheet material that includes an electrically conductive layer on a major surface therof.

23. The assembly of claim 1, wherein said flexible sheet material is made of a polymeric material, and wherein said electrically conductive layer includes copper.

24. A remote control toy assembly comprising:

a remote control device comprising:

a housing;

an antenna mechanism enclosed within said housing, said antenna mechanism including an electrically conductive layer positioned on an interior surface of said housing;

a user input mechanism; and a controller electrically coupled to said user input mechanism for transmitting an output signal to the remote control toy via said antenna mechanism, wherein said output signal is representative of a control input received from said user input mechanism; and a remote control toy responsive to said output signals for operation of said remote control toy.

25. The assembly of claim 24, wherein said electrically conductive layer is deposited in-situ on said interior surface of said housing.

26. A remote control toy assembly comprising:

a remote control device comprising:

a housing;

an antenna mechanism enclosed within said housing, said antenna mechanism including an electrically conductive layer at least partially embedded within said housing;

a user input mechanism;

a controller electrically coupled to said user input mechanism for transmitting an output signal to the remote control toy via said antenna mechanism, wherein said output signal is representative of a control input received from said user input mechanism; and a remote control toy responsive to said output signals for operation of said remote control toy.

* * * * *

UNITED STATES PATENT AND TRADEMARK OFFICE

CERTIFICATE OF CORRECTION

PATENT NO. : 6,529,139 B1
DATED : March 4, 2003
INVENTOR(S) : Catherine H. Behun It is certified that error appears in the above-identified patent and that said Letters Patent is hereby corrected as shown below:

Column 3,
Line 42, “min” should read -- in --.

Column 9,
Line 63, insert -- millimeters -- following “12.7”.

Column 10,
Line 27, “therof” should read -- thereof --.

Signed and Sealed this

Twenty-third Day of September, 2003

JAMES E. ROGAN
*Director of the United States Patent and Trademark Office*